US005545958A

United States Patent [19]

Kramer

[11] Patent Number: 5,545,958

[45] Date of Patent: Aug. 13, 1996

[54] MERCHANDISE DISPLAY SYSTEM

[75] Inventor: Richard H. Kramer, Glendale, Wis.

[73] Assignee: KCS Industries, Inc., Milwaukee, Wis.

[21] Appl. No.: 323,373

[22] Filed: Oct. 13, 1994

[51] Int. Cl.[6] ..... A47F 3/08

[52] U.S. Cl. ..... 318/560; 318/591; 108/20; 211/1.55

[58] Field of Search ..... 186/57, 58, 19–21; 211/1.52, 1.53, 1.55; 206/45.13, 6.1; 108/20, 21, 139, 142; 312/9.7, 125, 135, 305, 319.7; 318/560, 562, 567, 591, 600–603, 625, 49

[56] References Cited

U.S. PATENT DOCUMENTS

| | | | |
|---|---|---|---|
| 3,339,744 | 9/1967 | Ginsberg | 211/1.5 |
| 3,399,781 | 9/1968 | Nalbandian | 211/1.5 |
| 4,236,769 | 12/1980 | Mueller | 211/144 X |
| 5,088,604 | 2/1992 | Baur et al. | 211/163 X |
| 5,109,989 | 5/1992 | Kremmin et al. | 211/163 X |
| 5,206,814 | 4/1993 | Cahlander et al. | 221/88 X |
| 5,232,105 | 8/1993 | Gregg | 211/113 |
| 5,244,266 | 9/1993 | Maldanis | 312/116 |
| 5,330,062 | 7/1994 | Murphree | 211/122 |

*Primary Examiner*—Brian Sircus
*Attorney, Agent, or Firm*—Foley & Lardner

[57] ABSTRACT

A merchandising system for holding items, such as compact discs, is disclosed. The system includes a base on which several item holders are rotatably mounted. Each item holder is configured to receive at least one and preferably a plurality of items arranged vertically. A plurality of motors rotate the items while cooperating sensors provide an output corresponding to the rotational position of the item holder. A controller is coupled between the sensors and motors to maintain alignment of rotation based on the output signals received from the sensors.

11 Claims, 4 Drawing Sheets

MERCHANDISE DISPLAY SYSTEM

FIELD OF THE INVENTION

The present invention relates generally to an apparatus for displaying items, and more particularly, to an apparatus for rotating the displayed items to allow viewing from all sides while permitting a customer to selectively stop the rotation.

BACKGROUND OF THE INVENTION

A variety of display devices or systems are used to display goods to customers. For example, computer software packages, audio cassettes, and compact discs are often mounted on stationary racks either in the open or behind glass display doors. Other goods, such as cameras or guns are typically placed on shelves or in special holders mounted within a glass cabinet to permit viewing thereof.

There are a variety of problems with existing display systems including security and full display of all sides of the item. For example, if goods are placed in open racks to allow the customer to view all sides of the item, then there is a greater risk of losing goods to theft. On the other hand, if the goods are placed in a display behind locked glass doors, the customer is not able to examine all sides of the item. This problem is particularly pronounced with items such as computer software, audio or video cassettes, and compact discs. The packages containing such goods typically have important information on the front and back sides, but these items are also relatively easy prey for shoplifters.

The present invention addresses the drawbacks of current display devices.

SUMMARY OF THE INVENTION

The present invention features a merchandising system for holding items in adjacent columns. The merchandising system typically includes an enclosure having at least one transparent wall through which items may be viewed by a customer. The preferred enclosure includes a base in which a plurality of item holders are rotatably mounted. Each item holder is configured to receive and hold at least one item, and often each item holder will be configured to hold a plurality of items disposed in a vertical arrangement. A plurality of motors cooperate with the item holders to rotate them.

According to another aspect of the invention, there are a plurality of sensors cooperating with the item holders to maintain them in synchronous rotation. In one embodiment, each item holder cooperates with a corresponding sensor that provides an output indicating the rotational position of that item holder relative to the other item holders. A controller is coupled between the plurality of sensors and plurality of motors and is configured to receive the output signal and control the rotational position of each of the item holders.

According to another aspect of the invention, switches cooperate with groups of one or more item holders and are typically connected to a corresponding motor or motors. By actuating the switch, a customer or user may selectively stop rotation of one or more item holders to further examine the items being displayed.

BRIEF DESCRIPTION OF THE DRAWINGS

The invention will hereafter be described with reference to the accompanying drawings, wherein like referenced numerals denote like elements, and.

DETAILED DESCRIPTION OF THE PREFERRED EMBODIMENT

Figure 1:
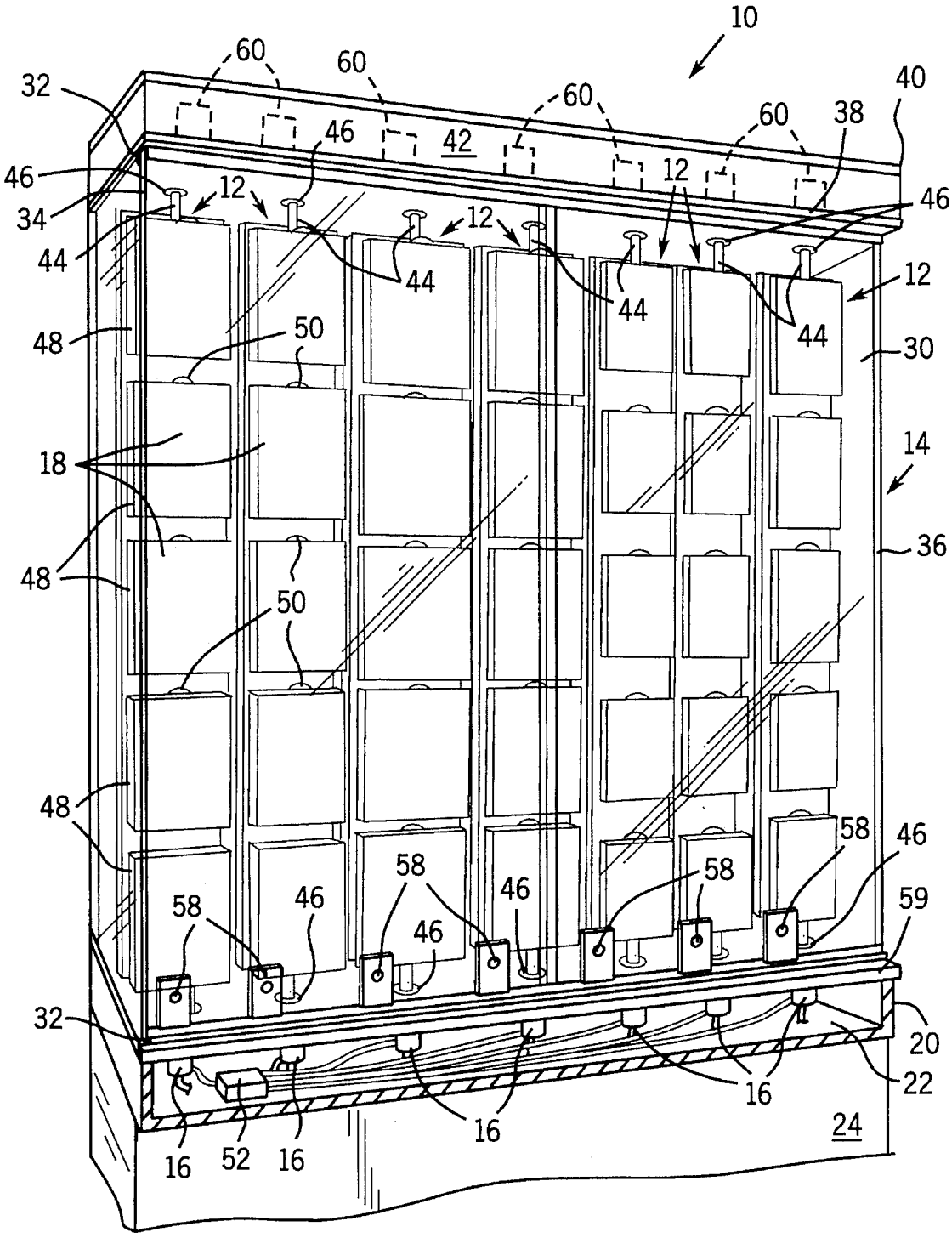
FIG. 1 is a perspective view of the overall merchandising system according to a preferred form of the present invention.
Figure 2:
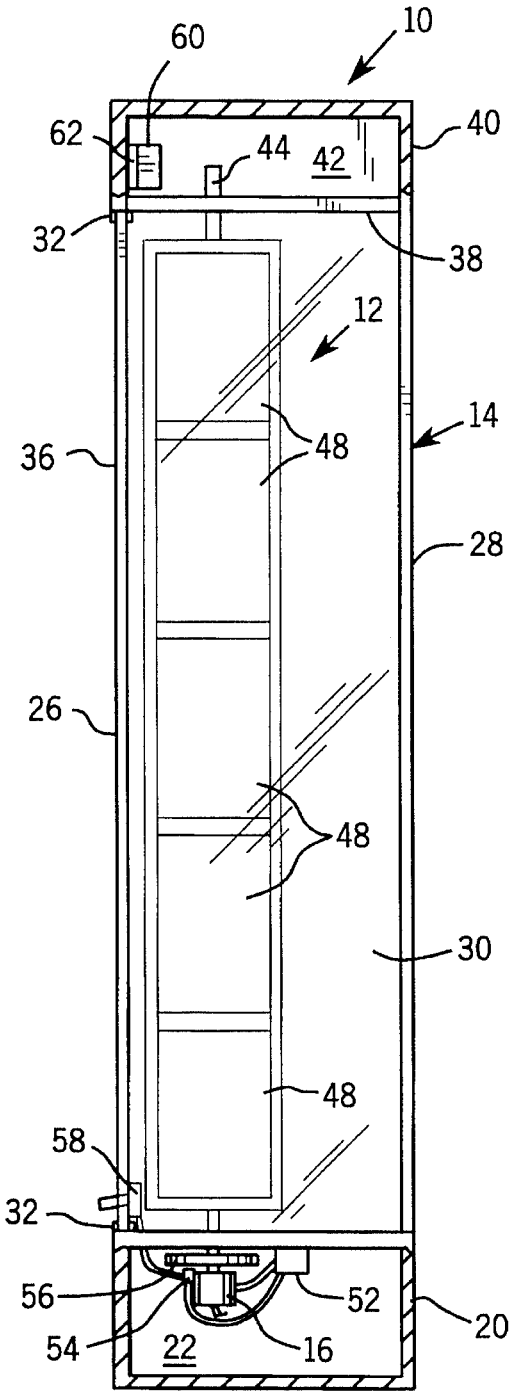
FIG. 2 is a side elevational view of the system shown in FIG. 1.

FIGS. 1 and 2 generally illustrate an apparatus 10 for displaying a variety of items, such as computer software packages, audio or video cassettes, compact discs, cameras, guns, or a variety of other display items. Apparatus 10 includes a plurality of item holders 12 mounted within an enclosure 14. A plurality of motors 16 cooperate with the item holders 12 and rotate them to display a plurality of items 18. In the alternative, a single motor 16 may be used to rotate all of the item holders 12 via a belt and pulley arrangement, for example.

Enclosure 14 typically includes a base portion 20 having a hollow interior 22 in which motors 16 are mounted. Base portion 20 may be mounted on a cabinet 24 or some other type of raised platform to hold apparatus 10 at a desirable level. Enclosure 14 also preferably includes a front wall 26, a back wall 28, and a pair of side walls 30 connected between front wall 26 and back wall 28. Typically, front wall 26 and possibly side walls 30 are made of a transparent material such as glass or plastic to facilitate viewing of items 18.

Front wall 26 is preferably a door slidably mounted in a pair of tracks 32. In the most preferred embodiment, front wall 26 comprises a left sliding door 34 and a right sliding door 36 which may be independently moved to provide access to item holders 12. However, the door or doors could be mounted in a variety of ways, including hinge mounts to allow pivotable movement of the doors between an open and a closed position. Additionally, a variety of conventional locks (not shown) may be used to secure the door or doors in a closed position.

Enclosure 14 preferably includes a top wall 38 extending between front wall 26 and back wall 28. A header 40 may be disposed over top wall 38 having a generally hollow interior 42.

Figure 3:
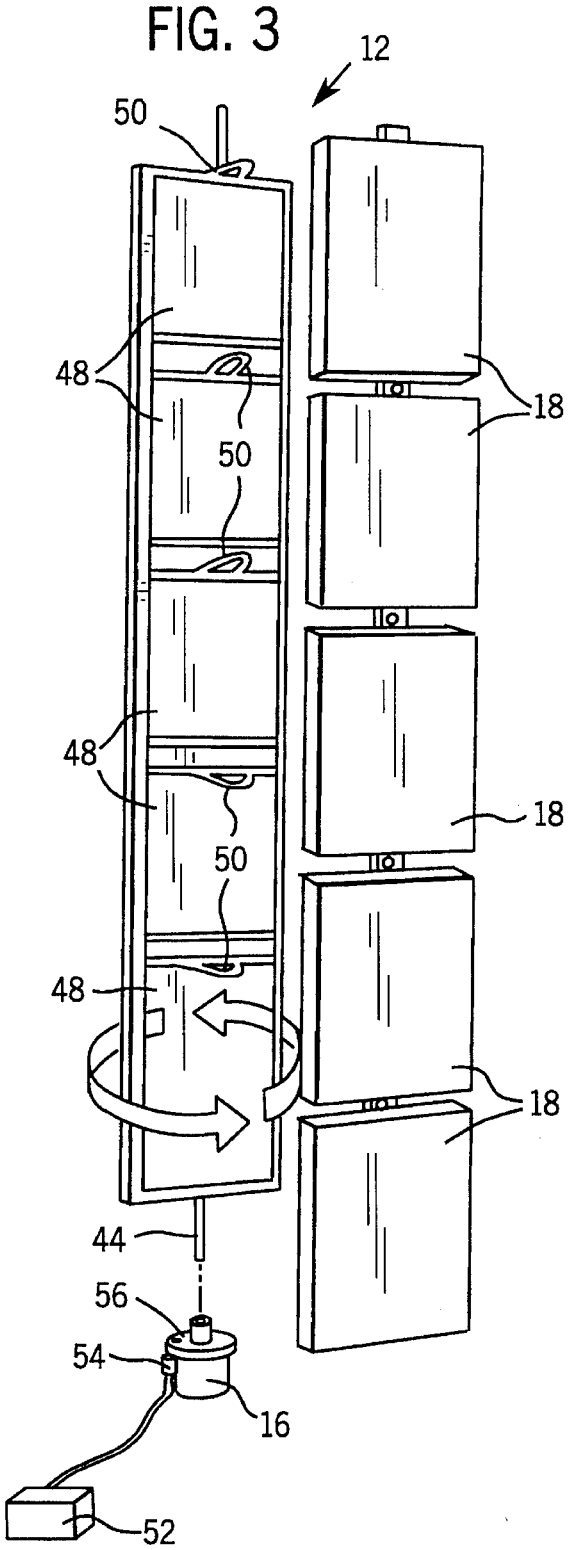
FIG. 3 is an exploded view of an exemplary embodiment showing how the items are mounted on an item holder.

Each item holder 12 preferably includes a shaft 44 which is rotatably received in a pair of bearings 46. Bearings 46 are typically mounted in top wall 38 and base portion 20 to support the item holder 12 vertically within enclosure 14. Although each item holder may be configured to hold a single item, such as a rifle, the item holder preferably includes a plurality of item holding sections 48 configured to receive and hold multiple items 18 in a generally vertical arrangement. Additionally, the item holding sections may include clips 50 or some other fastener designed to secure items 18. (See FIG. 3 which shows one example of the item holding sections 48.)

Figure 4:
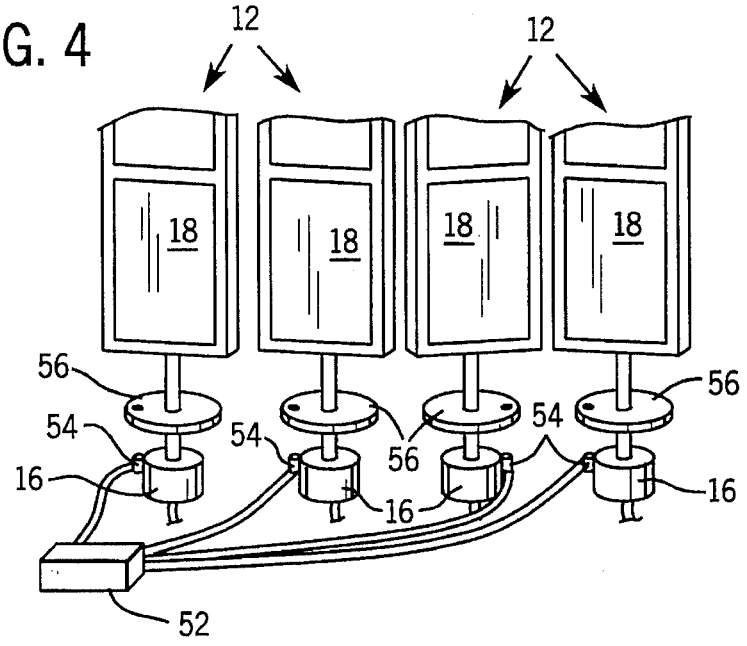
FIG. 4 is a schematic view of the motors and sensors cooperating with the logic controller.
Figure 4A:
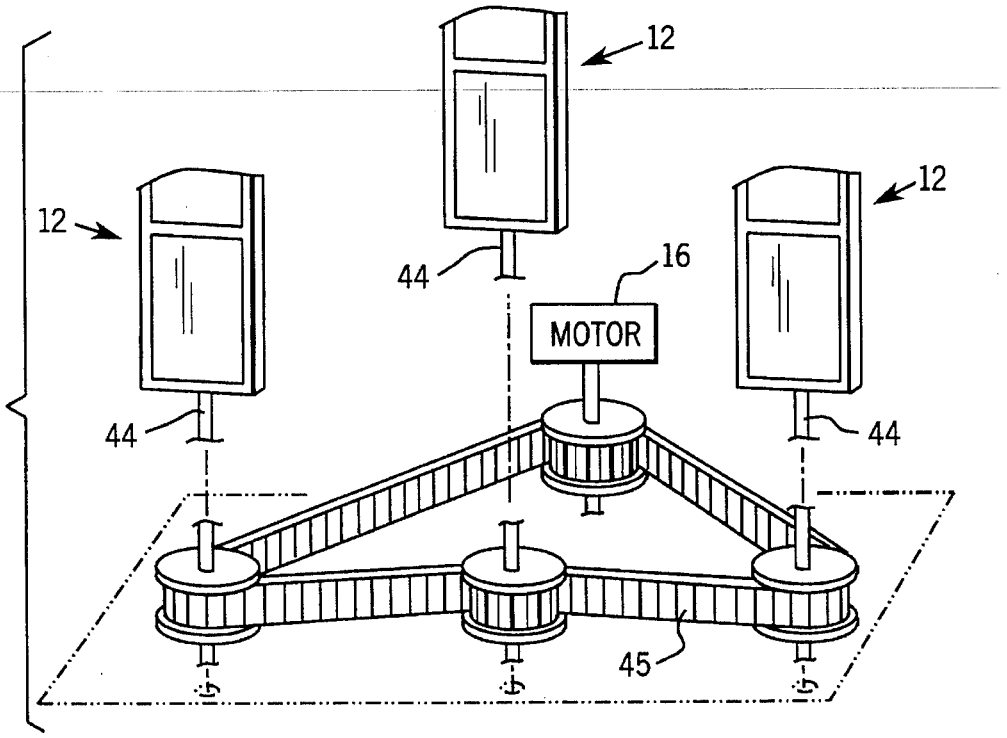
FIG. 4A is a schematic view of an alternate embodiment of a drive mechanism having a belt and pulley arrangement.

Each motor 16 may be connected to more than one item holder by gears or pulley and belt arrangements, but in the illustrated embodiment one motor 16 is connected to each shaft 44 of the corresponding item holder 12. In fact, one motor may be connected to all of the shafts 44 by a belt 45. (See the alternate embodiment belt 45 in FIG. 4A.) Motors 16 are typically mounted within the hollow interior 22 of base portion 20 and rotate the corresponding item holder 12 at a desired speed, such as two revolutions per minute. An example of a suitable motor 16 is the Model AR-DA Number 991258 manufactured by Hurst Motors, although a variety of other motors could be used depending on the particular application.

In one embodiment of the invention, motors 16 are connected to a logic controller 52, such as a microprocessor, to maintain synchronous rotation of the plurality of holders 12. In this embodiment, a plurality of sensors 54, such as hall effect sensors or optical sensors, are connected to logic controller 52 and mounted in proximity to shaft 44 on each item holder 12. Preferably, a positional indicator 56 is mounted on each shaft 44 in identical orientations so the corresponding sensors 54 will detect the positional indicators 56 at approximately the same time when the item holders are in synchronous rotation. In other words, each sensor 54 provides an output signal when activated by its corresponding indicator 56 and these output signals are received by logic controller 52. When the output signals are not received within a predetermined window of time, logic controller 52 cuts power to the motor or motors driving the out of synch item holders until the remaining item holders rotate to that same position. At that time, logic controller 52 actuates each of the motors 16 to maintain item holders 12 in synchronous rotation. (See FIG. 4.) Sensors 54 are mounted in a stationary position by attachment to the respective motors 16 or to the base portion 20.

In the illustrated embodiment, a plurality of switches 58 are generally mounted towards the front of apparatus 10 in an area easily accessible by the customer or user. Switches 58 are connected to motors 16 either directly or via logic controller 52. For example, if apparatus 10 is constructed without logic controller 52, each switch 58 would be connected directly to a corresponding motor 16, allowing the user to selectively stop or rotate each of the item holders 12. Preferably, a switch 58, such as a photocell, controls the rotation of each individual item holder 12. A user may simply hold his or her hand over the photocell to interrupt rotation of item holder 12 while reading or viewing a portion of one of the items 18. In the alternative, a single switch can be used to control all the item holders, for instance, when a single motor is used to rotate all the item holders. An example of this switch is a capacitance switch 59, such as those made by Reliable Electric Electronics Company, in the form of a touch pad attached along base portion 20.

It should be noted that a variety of motors 16, sensors 54, and switches 58 may be used. For example, in some applications, groups of item holders 12 may be rotated by a single motor controlled by a single switch 58.

Optionally, apparatus 10 may include voice playback devices to provide a variety of information regarding the items displayed. A plurality of messages can be stored on playback devices 60 and played to the customer through corresponding speakers 62 at select times. For example, it may be desirable to provide additional information about the particular items in a single item holder 12 when the customer actuates the corresponding stop switch 58. According to one embodiment, a solid state voice record/playback device is connected to each switch 58 to provide specific information about the items held by the corresponding item holder 12 when the switch is actuated. Examples of voice playback devices that could be used to provide the desired information are the ISD 1000 A series single-chip record and playback devices distributed by the Information Storage Devices Company. The voice information devices 60 can easily be mounted in the hollow interior 42 of header 40.

Figure 5:
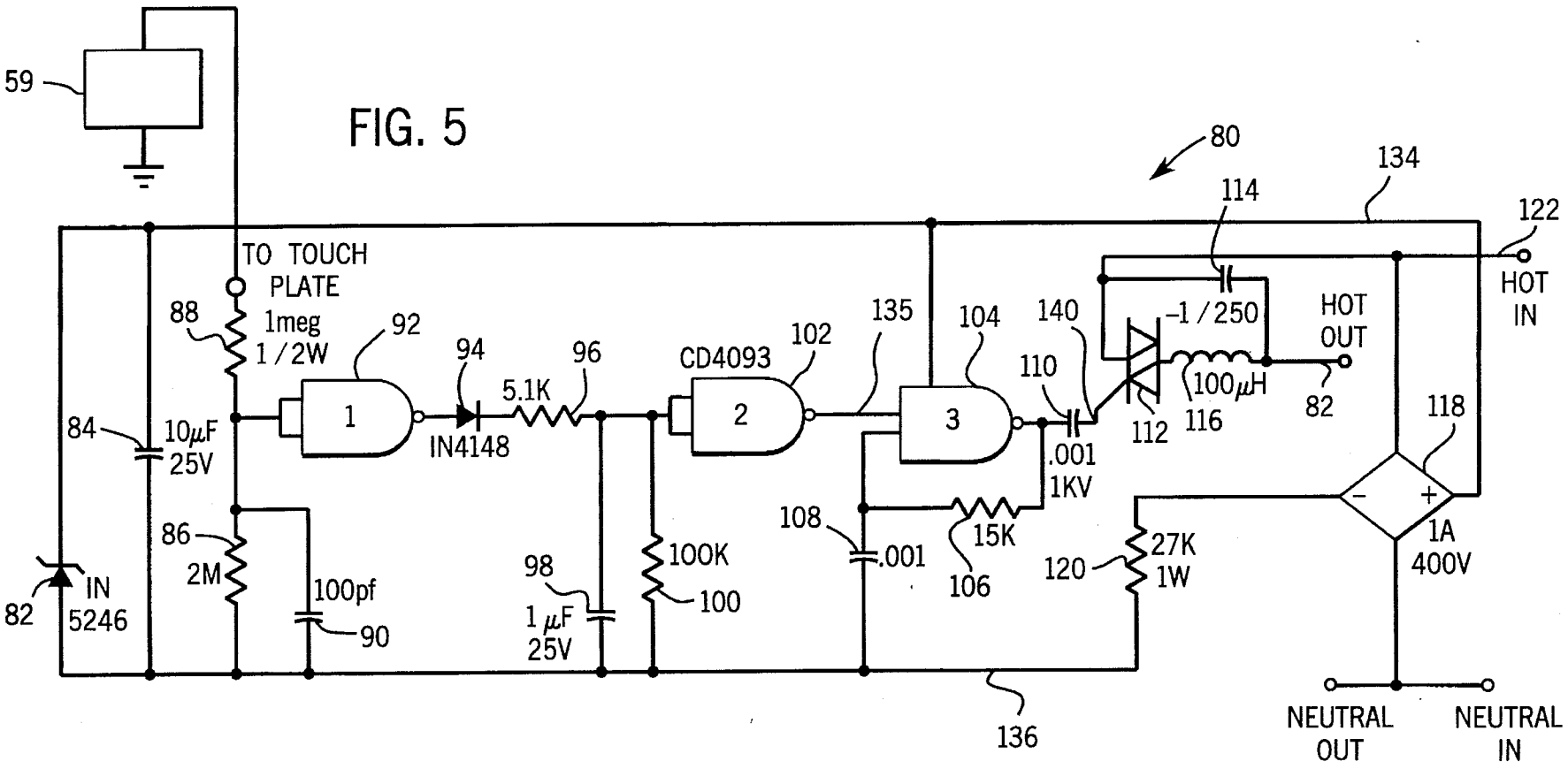
FIG. 5 is a detailed electrical schematic diagram of a capacitive switch control circuit for the system illustrated in FIG. 1.

With reference to FIG. 5, a capacitive switch control circuit 80 may be utilized to interrupt rotation of item holder 12 while a user is reading or viewing a portion of one of items 18. For example, control circuit 80 may include a touch pad or capacitance switch 59. When the user touches switch 59, circuit 80 prevents motor 16 from rotating by removing power at an output 82.

Control circuit 80 includes a zenar diode 82, a capacitor 84, a resistor 86, a resistor 88, a capacitor 90, a NAND gate 92, a diode 94, a resistor 96, a capacitor 98, a resistor 100, a NAND gate 102, a NAND gate 104, a resistor 106, a capacitor 108, a capacitor 110, a silicone controlled rectifier (SCR) 112, a capacitor 114, an inductor 116, a diode bridge 118, and a resistor 120. Preferred exemplary component names, interconnections and values are provided in FIG. 5. However, the component names, interconnections and values are given in an exemplary fashion only and do not limit the scope of the invention as recited in the claims.

Diode bridge 118, resistor 120 and zenar diode 82 cooperate to convert a 120 VAC power signal at an input 122 from a power source such as an electrical outlet (not shown) to a +5 VDC power signal between a conductor 134 and a conductor 136. NAND gate 92, NAND gate 102, diode 94, resistor 96, capacitor 98, and resistor 100 cooperate to buffer and filter the signal provided to an input 134 of NAND gate 92 from switch 59. When switch 59 provides a logic high (e.g., VCC or +5 VDC) at input 134, NAND gate 104 receives a logic high at an input 135. When switch 59 provides a logic low at an input 134, NAND gate 104 receives a logic low at input 135. SCR 112 preferably conducts (e.g., is turned ON) in response to a logic high at gate input 140 and provides the 120 VAC signal from input 122 to output 82. Capacitor 114 provides a discharge path for inductor 116 when SCR 112 is turned off.

In operation, when capacitance switch 59 is not touched, a logic low is provided to input 134, NAND gate 104 receives a logic low at input 135. NAND gate 104 provides a logic high to gate input 140 in response to the logic low at input 135, thereby turning on SCR 112. When SCR 112 is turned on, power from output 82 is provided to motor 16 and one or more of items 118 rotates. When NAND gate 104 provides a logic high, current travels through resistor 106 and charges capacitor 108 to a logic high. Capacitor 108 provides the logic high to an input 144 of NAND gate 104.

When a user places his hand or touches capacitance switch 59, switch 59 provides a logic high to input 134. When input 134 is a logic high, NAND gate 104 receives a logic high at input 135. If input 135 and input 144 of NAND gate 104 are both logic high, NAND gate 104 provides a logic low to gate input 140 and turns off SCR 112. When SCR 112 is turned off, power is not provided to motor 16 at output 82 and one or more of items 118 cease rotating.

If the user maintains his hand on capacitance switch 59 for approximately 15 to 30 seconds, capacitor 108 discharges to a logic low through resistor 106, thereby providing a logic low to input 144. When a logic low is provided on input 144, NAND gate 104 provides a logic high to gate input 140, turns ON SCR 112, and provides the power to output 82. Therefore, if a user maintains his hand on capacitance switch 59, power is provided to output 82 after a predetermined period of time (e.g., the RC time constant associated with resistor 106 and capacitor 108).

It will be understood that the foregoing description is of preferred exemplary embodiments of this invention, and that the invention is not limited to the specific forms shown. For example, a variety of enclosures may be used, different configurations of item holders may be designed according to the specific item being displayed, and a variety of switches, sensors, and motors may be used in various arrangements depending on the specific application. These and other modifications may be made in the design and arrangement of the elements without departing from the scope of the invention as expressed in the appended claims.

What is claimed is:

1. A merchandising system for holding items in adjacent columns, comprising:

a base;

a plurality of item holders rotatably mounted to the base, each item holder being configured to receive and hold at least one item;

a plurality of motors cooperating with the plurality of item holders to rotate each item holder;

a plurality of sensors, each sensor cooperating with a corresponding item holder to provide an output corresponding to the rotational position of that item holder relative to the other item holders; and a controller coupled between the plurality of sensors and the plurality of motors, the controller being configured to receive the output signal and control the rotational position of the plurality of item holders.

2. The merchandising system of claim 1, further comprising a plurality of switches cooperating with the plurality of motors, wherein each switch may be selectively actuated by a user to stop the rotation of at least one of the item holders.

3. The merchandising system of claim 2, wherein the plurality of switches are photocells.

4. The merchandising system of claim 1, further comprising an enclosure surrounding at least a portion of the item holders, the enclosure including a transparent wall through which the items may be viewed.

5. The merchandising system of claim 4, wherein the item holders include a plurality of display sections disposed above each other in a vertical arrangement.

6. The merchandising system of claim 1, wherein there are a plurality of motors including an independent motor cooperating with each item holder.

7. The merchandising system of claim 2, wherein each switch is a capacitance switch.

8. The merchandising system of claim 4, wherein the enclosure includes a door operable to provide access to the item holders.

9. The merchandising system of claim 8, wherein the enclosure includes a track and the door is slidably mounted in the track.

10. The merchandising system of claim 1, further comprising a plurality of voice playback devices connected to the switches to provide a desired message depending on the switch actuated by the user.

11. The merchandising system of claim 1, further comprising an interrupt mechanism cooperating with the plurality of item holders and the plurality of motors to permit the interruption of rotation of a single item holder while the remaining item holders continue to rotate, the interrupt mechanism being further configured to reinitiate rotation of the single item holder.

* * * * *